US005473502A

United States Patent [19]

Bonavia et al.

[11] Patent Number: 5,473,502

[45] Date of Patent: Dec. 5, 1995

[54] EXCITER WITH AN OUTPUT CURRENT MULTIPLIER

[75] Inventors: Howard V. Bonavia, Groton; Dale F. Geislinger, Norwich; Michael J. Terzo, Bainbridge, all of N.Y.

[73] Assignee: Simmonds Precision Engine Systems, Akron, Ohio

[21] Appl. No.: 384,602

[22] Filed: Feb. 3, 1995

Related U.S. Application Data

[63] Continuation of Ser. No. 949,319, Sep. 22, 1992, abandoned.

[51] Int. Cl.[6] ..... F02B 9/06; F02P 19/02

[52] U.S. Cl. ..... 361/256; 123/145 A; 361/263

[58] Field of Search ..... 361/253, 256, 361/263, 247, 248, 257, 251; 307/109, 110; 123/145 A, 620; 315/209 CD; 313/118, 53

[56] References Cited

U.S. PATENT DOCUMENTS

| | | | |
|---|---|---|---|
| 962,417 | 7/1864 | Barrington et al. . | |
| 2,737,612 | 3/1956 | Sims | 315/177 |
| 2,896,123 | 7/1959 | McNulty | 315/177 |
| 2,995,685 | 8/1961 | Lord . | |
| 3,111,632 | 11/1963 | Murphy | 331/113 |
| 3,129,374 | 4/1964 | Relation et al. | 321/14 |
| 3,395,686 | 8/1968 | Minks | 123/148 |
| 3,407,795 | 10/1968 | Aiken et al. | 123/148 |
| 3,421,825 | 1/1969 | Maycock | 431/208 |
| 3,531,738 | 9/1970 | Thakore | 331/111 |
| 3,534,719 | 10/1970 | Minks | 123/102 |
| 3,556,706 | 1/1971 | Campbell | 431/265 |
| 3,571,609 | 3/1971 | Knudson | 307/106 |
| 3,575,153 | 4/1971 | Hardin | 123/148 |
| 3,581,726 | 6/1971 | Plume, Jr. | 123/148 |
| 3,583,378 | 6/1971 | Pattee | 123/148 |
| 3,584,929 | 6/1971 | Schuette | 315/244 |
| 3,605,714 | 9/1971 | Hardin et al. | 123/148 E |
| 3,619,638 | 11/1971 | Phinney | 307/106 |
| 3,635,202 | 1/1972 | Issler et al. | 123/148 |
| 3,675,077 | 7/1972 | Minks | 315/209 |
| 3,714,507 | 1/1973 | Schweitzer et al. | 123/148 |
| 3,716,758 | 2/1973 | Palazzetti . | |
| 3,731,144 | 5/1973 | McKeown | 315/209 |
| 3,740,589 | 6/1973 | Minks | 307/275 |
| 3,769,545 | 10/1973 | Crane | 315/219 |
| 3,806,305 | 4/1974 | Dietz et al. | 431/74 |
| 3,818,885 | 6/1974 | Canup | 123/148 |

(List continued on next page.)

FOREIGN PATENT DOCUMENTS

| | | |
|---|---|---|
| 0481609A2 | 4/1992 | European Pat. Off. . |
| 1108636 | 4/1968 | United Kingdom . |

OTHER PUBLICATIONS

SCR Applications Handbook, Edited by Dr. Richard G. Hoft, First Printing Sep. 1974, pp. 140–145.

Society of Automotive Engineers, Inc., Aerospace Information Report, AIR 784A, Jun. 15, 1975, pp. 1–27.

*Primary Examiner*—A. D. Pellinen

*Assistant Examiner*—Richard T. Elms

*Attorney, Agent, or Firm*—Leonard L. Lewis; William E. Zitelli

[57] ABSTRACT

An exciter for an internal combustion engine igniter plug, comprises a continuous AC charging circuit and a discharge circuit. The discharge circuit is connectable to the plug and the charging circuit includes a transformer having a primary winding connectable to an AC power source and a secondary winding connected to the discharge circuit. The discharge circuit includes a storage capacitor connected to the transformer secondary winding such that current induced in the secondary charges the capacitor at a generally constant rate. A switching device is connected in series between the capacitor and the plug; and a trigger circuit triggers the switching device in response to charge on the capacitor; with the charging circuit and trigger circuit operating to maintain a generally constant spark rate. A current multiplier is also provided to substantially increase the peak currents delivered to the plug.

22 Claims, 2 Drawing Sheets

U.S. PATENT DOCUMENTS

| | | | |
|---|---|---|---|
| 3,824,432 | 7/1974 | Gersing . | |
| 3,835,350 | 9/1974 | Thakore | 315/209 |
| 3,838,328 | 9/1974 | Lundy | 321/2 |
| 3,849,670 | 11/1974 | Lourigan | 307/108 |
| 3,869,645 | 3/1975 | Collins | 315/209 |
| 3,889,160 | 6/1975 | Cobarg . | |
| 3,894,273 | 7/1975 | Newport, Jr. et al. . | |
| 3,906,919 | 9/1975 | Asik et al. | 123/148 |
| 3,910,246 | 10/1975 | Canup | 123/148 |
| 3,958,168 | 5/1976 | Grundberg | 321/2 |
| 3,961,613 | 6/1976 | Canup | 123/148 |
| 4,027,198 | 5/1977 | Linkroum | 315/209 |
| 4,122,816 | 10/1978 | Fitzgerald et al. | 123/148 |
| 4,133,329 | 1/1979 | Caron | 123/148 |
| 4,136,301 | 1/1979 | Shimojo et al. | 315/209 |
| 4,153,032 | 5/1979 | Chateau | 123/148 |
| 4,154,205 | 5/1979 | Forster | 123/148 |
| 4,191,911 | 3/1980 | Gerry | 315/209 |
| 4,203,052 | 5/1980 | Bechtel | 315/209 |
| 4,244,337 | 1/1981 | Asai | 123/603 |
| 4,245,609 | 1/1981 | Gerry | 123/594 |
| 4,247,880 | 1/1981 | Morio | 361/256 |
| 4,261,025 | 4/1981 | Chafer et al. | 361/257 |
| 4,285,321 | 8/1981 | Phelon et al. | 123/599 |
| 4,329,628 | 5/1982 | Bohan, Jr. | 315/209 |
| 4,344,122 | 8/1982 | Jones | 363/23 |
| 4,349,008 | 9/1982 | Wainwright | 123/620 |
| 4,398,128 | 8/1983 | Wollank | 315/158 |
| 4,418,375 | 11/1983 | Ober | 361/253 |
| 4,424,556 | 1/1984 | Maeda et al. | 363/17 |
| 4,430,628 | 2/1984 | Nilssen | 331/113 |
| 4,432,646 | 2/1984 | Rodloff et al. | 356/350 |
| 4,454,560 | 6/1984 | Nakao et al. | 361/257 |
| 4,457,285 | 7/1984 | Hamai et al. | 123/598 |
| 4,506,650 | 3/1985 | Shimojo et al. | 123/620 |
| 4,522,184 | 6/1985 | Lepley | 123/599 |
| 4,535,380 | 8/1985 | Geary | 361/256 |
| 4,561,707 | 12/1985 | Jackson | 315/209 |
| 4,613,797 | 9/1986 | Eggers et al. | 315/241 |
| 4,696,280 | 9/1987 | Niggemeyer | 123/598 |
| 4,705,013 | 11/1987 | Minks | 123/598 |
| 4,774,924 | 10/1988 | Minks | 123/618 |
| 4,791,349 | 12/1988 | Minks | 323/266 |
| 4,833,369 | 5/1989 | White | 315/209 |
| 4,839,772 | 6/1989 | Choi et al. | 361/256 |
| 4,922,396 | 5/1990 | Niggemeyer | 363/21 |
| 4,983,886 | 1/1991 | Balland | 315/209 |
| 5,030,883 | 7/1991 | Bonavia | 315/56 |
| 5,032,969 | 7/1991 | Eggers et al. | 363/21 |
| 5,049,786 | 9/1991 | Gotisar et al. | 315/209 CD |
| 5,053,913 | 10/1991 | Lozito et al. | 361/257 |

EXCITER WITH AN OUTPUT CURRENT MULTIPLIER

This is a continuation of application Ser. No. 07/949,319 filed on Sep. 22, 1991 now abandoned.

BACKGROUND OF THE INVENTION

The invention relates generally to exciter circuits for ignition systems used with internal combustion engines. More particularly, the invention relates to exciter circuits that utilize solid-state switches such as, for example, thyristors, as control devices for spark rate timing.

A conventional ignition system for an internal combustion engine, such as, for example, a gas turbine aircraft engine, includes a charging circuit, a storage capacitor, a discharge circuit and at least one igniter plug located in the combustion chamber. The discharge circuit includes a switching device connected in series between the capacitor and the plug. For many years, such ignition systems have used spark gaps as the switching device to isolate the storage capacitor from the plug. When the voltage on the capacitor reaches the spark gap breakover voltage, the capacitor discharges through the plug and a spark is produced.

More recently, turbine engine and aircraft manufacturers have become interested in replacing the spark gap with a solid-state switch, such as an SCR or thyristor. This is due, in part, because a solid state switch typically operates longer than a spark gap tube which may exhibit electrode erosion. Also, solid state switches are produced in large volume making them less expensive than spark gaps which are individually crafted in small quantities. Furthermore, the storage capacitor's voltage at discharge remains essentially constant over the life time of the solid state switch, but can change significantly during the life of the spark gap due to electrode erosion.

However, there are also significant disadvantages to replacing a spark gap with a solid state switch. One concerns the peak power produced by the spark discharge pulse. Although spark energy is about the same for the spark gap and solid state switch designs, peak spark power is severely reduced using known solid state switch designs because the solid state switch limits peak discharge current to about 1000 amps with a current transition rate (i.e. di/dt) limit of about 200 amps/μsecond. In contrast, spark gap discharge currents rise rapidly at about 1000 amps/μsecond to a peak of about 2000 amps. This produces a high peak power that causes a loud bang and sonic shock wave that emanates from the igniter tip. It is this shock wave that breaks up and disperses the fuel particles making them easier to ignite. The high peak current and current transition rates required for high peak power do not present a problem for spark gaps but are of a destructive nature for present solid state thyristors.

When a solid state switch such as, for example, a thyristor, is initially gated on, only a very small portion of the die area around the gate electrode attachment conducts current due to a finite spreading velocity. If a fast rising current is permitted at turn on, a high current density occurs in the small conducting area of the die resulting in high switching losses. These high losses create excessive heating and are of a destructive nature to the thyristor device. To allow proper current spreading of the entire die area which will permit a safe operating environment for the thyristor, a saturable core inductor, often referred to as a delay reactor, must be incorporated in the circuit design. The delay reactor is connected in series with the thyristor switch, and the inductance of the reactor limits the rate of rise of the current (di/dt) for a period of time while the thyristor is turning on. Once the thyristor is in full conduction, the delay reactor's core saturates and the inductance becomes so small that it no longer affects the circuit operation.

If too high a di/dt level is being applied to a conventional thyristor device, the thyristor will eventually and gradually become leaky, and a reduction in the breakover voltage will slowly occur. The rate at which these changes take place is dependent upon how high the di/dt levels are that the switching device experiences over time.

Based on testing that has been conducted by engine manufacturers on ignition systems that employ solid-state technology, ignition lightoff has been a problem and a concern. It is believed that these no lightoff conditions are caused by at least two characteristic differences. One is that the reduced peak power level is not sufficient to maintain a clear plug, thereby resulting in the absence of a spark due to contamination fouling. The second condition results in less of a shock wave being developed, as a result of the peak power reduction, which may not be sufficient for igniting the fuel particles under more severe fuel-air ratios and contaminated mixtures.

Another disadvantage to present solid state switch designs is that leakage current of conventional thyristors increases significantly at high operating temperatures. These leakage currents act as load on the charging circuitry and divert charging current away from the main storage capacitor. This causes the spark rate to decrease. To maintain a constant spark rate, known exciter designs must utilize additional timing and regulating circuitry to compensate for the leakage problem.

Thus, there is a present need for a simple and reliable exciter, preferably using solid-state switches, that produces high energy sparks with high peak power at a constant spark rate without switch degradation.

SUMMARY OF THE INVENTION

In accordance with a preferred embodiment of the present invention, an exciter for an internal combustion engine igniter plug is provided that includes a continuous AC charging circuit and a discharge circuit with the discharge circuit being connectable to the igniter plug to cause the plug to produce sparks. The charging circuit is connectable to an AC power source. The charging circuit includes a transformer having a primary winding connectable to the AC source and a secondary winding connected to the discharge circuit. The discharge circuit includes a storage capacitor connected to the transformer secondary so that current induced in the secondary charges the capacitor at a generally constant average rate between sparks; a solid state switching device connected in series between the capacitor and the plug; and a trigger circuit for triggering the switching device in response to charge on the capacitor, such that the charging circuit and the trigger circuit operate to maintain a generally constant spark rate.

The invention also contemplates an improved exciter that can be used with AC and/or DC charging circuits and that includes a current multiplier connected between the switching device and the igniter plug.

The invention also provides methods for using these exciters, as well as a method for producing a constant spark rate from an igniter plug in an internal combustion engine, such method including the steps of producing a half-wave rectified charging current from a continuous AC power source; charging a capacitor with the charging current at a generally constant average rate of charge between sparks; detecting the charge on the capacitor; triggering a switching device in response to charge on the capacitor to discharge the capacitor through the igniter plug; and turning the switching device off during a non-charging half cycle of the charging current after the capacitor discharges.

These and other aspects and advantages of the invention are more fully described in and will be readily appreciated by those skilled in the art from the following detailed description of the preferred embodiments in view of the accompanying drawings.

DESCRIPTION OF THE PREFERRED AND ALTERNATIVE EMBODIMENTS

Figures 1, 3A, 3B:
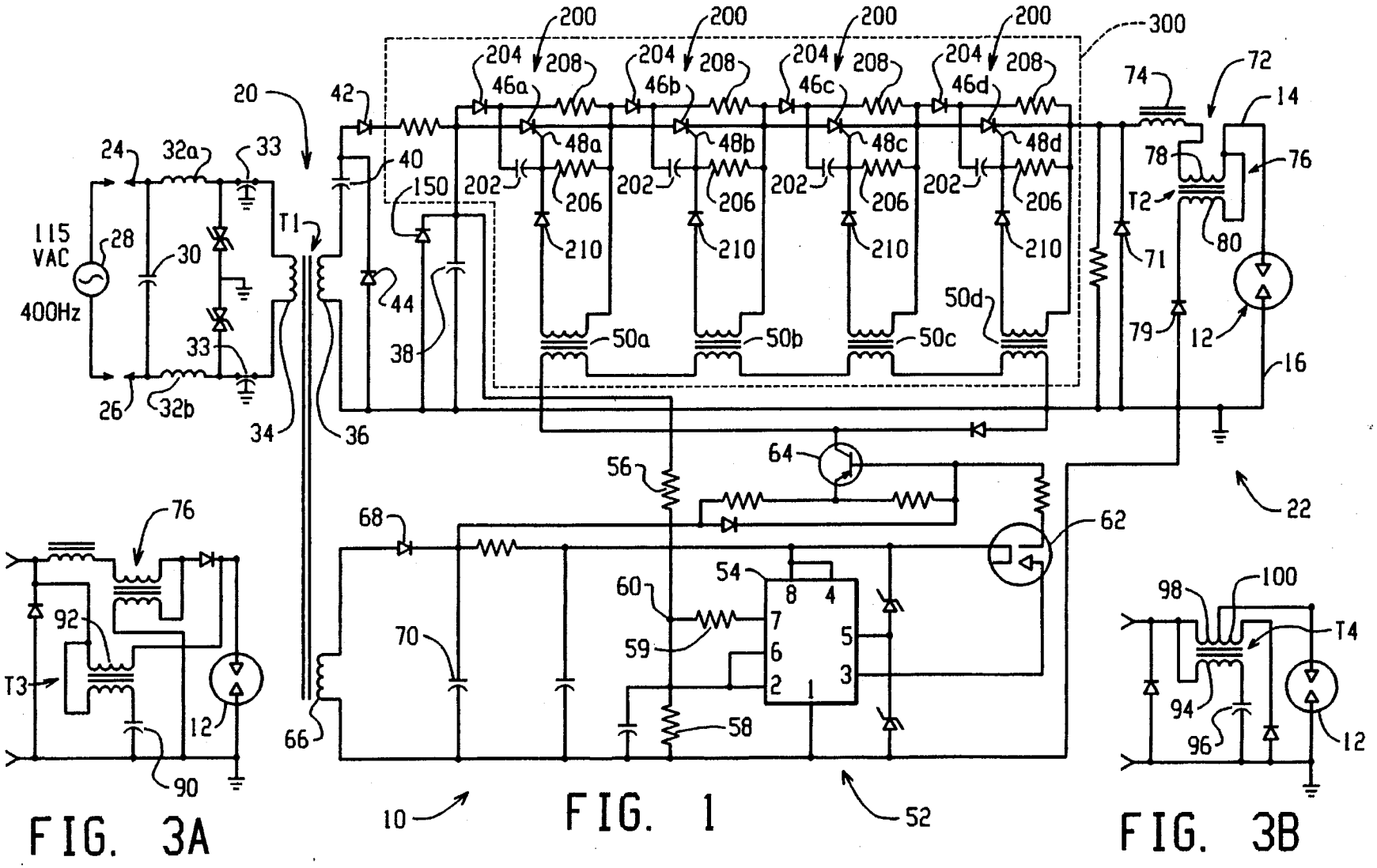
FIG. 1 is an electrical schematic diagram of an exciter circuit according to the present invention.
FIGS. 3A and 3B illustrate some alternative embodiments of the invention.

With reference to FIG. 1, an exciter in accordance with the present invention is generally designated by the numeral 10. Such an exciter is particularly well suited for use in an ignition system for a gas turbine engine, such as, for example, in aircraft engines. However, exciters in accordance with the invention can also be used other than in the aircraft applications. One of the basic functions of the exciter 10 is to produce high energy sparks at the igniter plug gap; which is shown in a simplified schematic manner in FIG. 1 and designated with the numeral 12. An important requirement imposed by engine manufacturers is that the spark rate should be generally constant over a wide operating temperature range of the exciter.

The plug 12, of course, is physically positioned in the combustion chamber of the engine (not shown). The exciter 10 is connected to the plug by a high tension lead wire 14 and a return 16.

The exciter 10 includes an uninterrupted charging circuit 20 and a discharge circuit 22. The charging circuit 20 is connectable by leads 24,26 to an AC power supply 28, such as, for example, a 115 VAC 400 Hz supply from the engine power plant. By "uninterrupted" we mean that during normal use of the exciter to produce sparks, the AC power supply 28 energizes the charging circuit 20 to operate in a continuous manner. The AC power supply 28 connects in parallel with a capacitor 30 which may be provided for power factor correction, as is well known to those skilled in the art. A pair of current regulating inductors 32*a* and 32*b* are connected in series between the power supply 28 and a primary winding 34 of a power transformer T1. The inductors 32a,b operate to maintain a generally constant current through the primary winding of the transformer T1, and this current is generally independent of variations of input voltage as long as the ratio of input voltage to input frequency remains generally constant. A pair of capacitors 33 are provided for low pass filtering.

Current induced in the secondary winding 36 of transformer T1 is used to charge a main storage capacitor 38. Because the primary current is generally constant, the capacitor 38 charges at a constant average rate between sparks. In this exemplary embodiment, the charging circuit 20 produces about 10 watts of power for charging the main capacitor 38. The secondary winding 36 is connected to the capacitor 38 by means of a half-wave rectified voltage doubler constituted by a capacitor 40 and two diodes 42,44. During each negative half-cycle of the current induced in the secondary, no charging current is applied to the main capacitor 38, however, the capacitor 40 is charged to the voltage output of the secondary winding 36 through the diode 44. On the succeeding positive half-cycle, charging current is applied to the main capacitor 38 through the second diode 42 to a voltage that is approximately twice the output voltage of the transformer T1. Two important aspects of this design should be noted. First, during alternating half-cycles of the 115 VAC input, no charging current is applied to the main capacitor 38. Second, however, the average rate of charge of the capacitor 38 is generally constant between sparks because of the generally constant current supplied through the primary and secondary windings of the transformer T1.

The discharge circuit 22 further and preferably includes a cascaded set of switching devices 46*a*, 46*b*, 46*c* and 46*d*. In the preferred embodiment, the devices 46*a–d* are SCR thyristor devices or GTO devices. Although four devices are shown in FIG. 1, the actual number of such devices used will depend on the particular requirements of the ignition system, primarily the type of switching device used, the type of plug used, and the operating voltages, currents and temperatures. For example, a standard SCR can only withstand or block 1000–1500 VDC, therefore, if the capacitor 38 needs to be charged to 3000 VDC or more then several SCR devices need to be used. It will be appreciated that the series string of switching devices 46 can also be thought of as a single switching device connected between the main capacitor 38 and the plug 12. Those skilled in the art will readily appreciate that the voltage imposed on the capacitor 38 will depend on the type of plug being used, as well as the type of output conditioning circuit employed with the discharge circuit, as will be more fully explained herein.

The switching devices 46*a–d* are triggered on in response to a current pulse applied to their respective gate terminals 48*a–d*. These trigger pulses are applied to the gates 48*a–d* by a set of corresponding pulse transformers 50*a–d*. In order to produce the trigger pulses with the correct timing, a trigger circuit 52 monitors the charge on the main storage capacitor 38. The trigger circuit 52 includes a comparator device 54, such as, for example, part no. ICM 7555 manufactured by Maxim.

A series pair of resistors 56,58 provide a resistor divider circuit connected in parallel with the main capacitor 38. The resistor divider junction node 60 is connected to input pins and 6 of the comparator device 54. When the voltage at the junction node 60 exceeds a first predeterminable threshold at pin 6, the device 54 latches a low going signal at an output pin 3 and at pin 7. The low signal at pin 7 pulls the node 60 towards a second lower threshold detected at pin 2, in essence resetting the comparator so that the output at pin 3 goes back high after a predetermined time, thus creating a pulse at pin 3. This pulse may be, for example, 30 μseconds in duration. The pulse duration can be set by selection of a discharge resistor 59 value. The output pulse from the comparator 54 pulses on an FET switch which in turn pulses on a PNP switch 64. The pulsed PNP switch conducts current through the primary of the pulse transformers 50*a–d* thereby triggering the switching devices 46*a–d* on.

Power for the trigger circuit 52 can be conveniently provided using a tertiary winding 66 of the power transformer The tertiary current is rectified and filtered by a diode 68 and capacitor 70 to provide a DC voltage supply for the comparator device 54. This DC supply may also be used to establish the bias voltages for the FET and PNP switches 62,64.

The switching devices 46*a–d* are connected in series between the main capacitor 38 and an output conditioning circuit 72. The output circuit 72 may include a current limiting saturating core inductor 74 that momentarily limits the initial current surge through the switches 46*a–d* when these devices are initially switched on. This may be important when conventional SCRs are used for the switching devices because the extremely high current surges could otherwise damage or degrade the SCR devices.

It should be noted at this time that in a conventional capacitive discharge ignition circuit, the current and voltage waveforms can be divided into three rather distinct time periods. During the arc inception period, in a typical low tension application for example, the storage capacitor 38 is charged to about 3000 volts, and when the switching device is closed, the high impedance gap of the plug 12 sees a voltage above the gap breakover voltage (of course, in a high tension circuit, the capacitor 38 voltage is stepped-up such as with a step-up transformer in the output circuit so as to increase the voltage across the plug gap sufficient to create the arc). As arc current rises from 0 to several amps, the plug 12 impedance falls rapidly, the plug voltage falls to about 50 volts and the capacitor 38 voltage now appears mainly across the saturable inductor 74. Thus during this period, high voltage and low current from the storage capacitor strike an arc across the high impedance plug gap.

The next time period of interest occurs as the capacitor 38 energy is transferred to the saturable inductor 74 as the capacitor discharges to zero volts and the inductor 74 current, in essence the loop current through the plug 12, increases to about 2000 amps. During this energy transfer period of time, energy is now transferred from the high voltage source of the capacitor 38 to the high current source of the inductor 74 to supply energy to the low impedance spark gap.

Then, during the arc period, the energy stored in the inductor 74, which may be nearly 95% of the energy initially stored on the capacitor 38, is transferred to the arc of the plug 12. The inductor 74 circulates current around the loop consisting of the inductor 74, the plug 12, and the clamp rectifier 71. The current then decays from a peak of about 2000 amps to zero during this time.

The requirement that the switching devices 46*a–d* block high voltage during the capacitor 38 charging time and conduct fast rising high peak currents during the energy transfer period is difficult to realize using a conventional thyristor device. This is due to the current limitations of these devices as explained hereinabove. In accordance with the invention, a current multiplier is used in the output circuit 72 to circumvent this current limitation.

Figure 2:
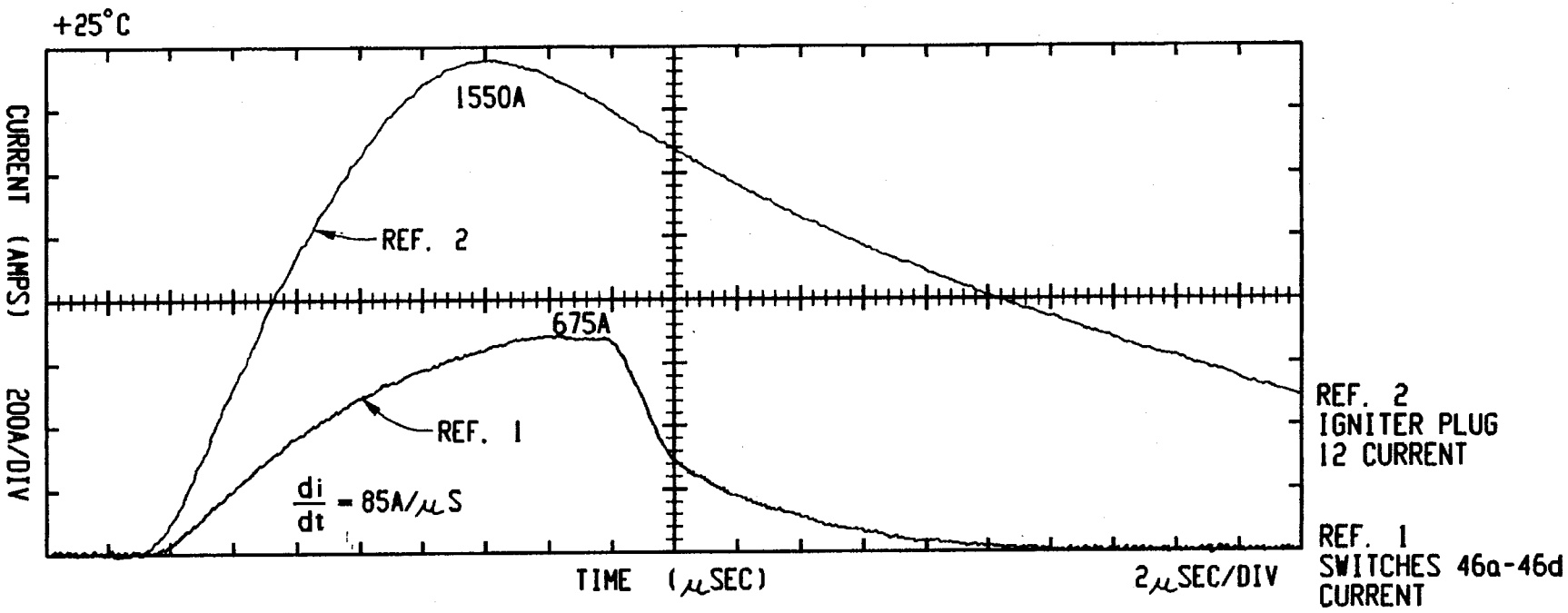
FIG. 2 is a graph of typical operating currents produced by the circuit of FIG. 1.

Thus, the output circuit 72 includes a current multiplier 76 connectable in series with the igniter plug 12. The current multiplier 76 may be realized conveniently in the form of an autotransformer T2 having windings 78 and 80 on a common core, with a rectifier 79 being series connected between winding 80 and the return line 16. The primary winding of T2 consists of both windings 78,80 in series after the arc is established; and the secondary is winding 80 which means that winding 80 is shared by the primary and secondary. The windings 78 and 80 may have the same number of turns. When the switching devices 46*a*–46*d* close, the rectifier 79 blocks magnetizing current through the common winding 80, which prevents the autotransformer 76 from initially operating which would otherwise limit open circuit voltage to the plug 12; and the inductance of inductor 74 and the winding 78 impedes the arc inception current to the plug 12 thus protecting the switching devices. As the plug 12 impedance drops rapidly to a point at which the plug voltage is approximately the capacitor 38 voltage divided by the autotransformer 76 turns ratio, the autotransformer begins operating such that current now flows through windings 78,80 and the plug 12. After the arc is struck and as the voltage across the plug gap drops rapidly to 50 volts, the winding 80 conducts high current to the plug gap to give high peak currents and high transition currents without degrading switch 46*a*–46*d* performance. Magnetizing current provided in the primary 78,80 of T2 during discharge of the main capacitor 38 induces a load current in the secondary 80, which current is added to the main capacitor discharge current to substantially increase the power delivered to the plug when a spark is created. FIG. 2 illustrates typical current characteristics for current through the switching devices 46*a–d* (REF 1) and current through the plug 12 (REF 2) using a current multiplier 76.

It should be noted that the current multiplier 76 can be used to provide the plug 12 with discharge current peaks and transition rates similar to those provided by a spark gap and at the same time reduce current peaks and transition rates conducted by the solid state switch to levels consistent with their capability. In this case, inductor 74 need not be of the saturable type.

In operation, AC power applied to transformer T1 continuously energizes the charging circuit 20 which charges the main capacitor 38 at a generally constant average rate. However, during each half-cycle of the AC supply, no charging current is applied to the capacitor 38 due to operation of the half wave doubler circuit connected between the charging circuit 20 and the storage capacitor 38. When the capacitor is sufficiently charged to a voltage level adequate to produce a spark at the plug 12, the comparator 54 generates a trigger pulse that gates the switching devices 46*a–d* on. The capacitor 38 is thus shorted across the plug 12 and transformer T2. The main capacitor 38 discharges through the current multiplier 76 and a high energy spark is created. After the capacitor discharges, the switching devices 46 are able to turn off because the current through the devices falls below the sustaining level needed to keep the devices on when the succeeding half cycle of charging current is blocked. Thus the circuit is self-commutated without the need for a controlled switch or a controlled reactance to interrupt the supply of charging current or the need for a forced commutation circuit to by-pass charging current around the switching devices. As soon as the switching devices 46*a–d* turn off, the capacitor 38 immediately begins charging again at the same generally constant average rate between sparks and the process repeats continuously as long as AC power is provided to the charging circuit 20.

In a typical exciter, the capacitor 38 is charged to about 3000 VDC. The capacitor discharges in 100 μseconds or less and can produce discharge currents as high as 2000 amps. Because the AC supply is preferably operating at 400 Hz, there is at least a 1.25 millisecond commutation period during which no charging current is applied to the capacitor 38. This is more than adequate time to insure that the switching devices 46*a–d* turn off within one cycle of the discharge time.

An important aspect of this invention is that an exciter is provided that operates in a continuous and uninterrupted charging mode without the need for timing circuits to achieve a constant spark rate. By designing the AC charging circuit 20 to continuously charge the capacitor 38 at a generally constant average rate between sparks, the AC charging power need not be interrupted and can be continuously applied to the capacitor 38. Because the comparator 54 always trips at the same reference level, a constant spark rate can be maintained without using any timer circuits. This is particularly useful with GTO devices used for the switches 46*a–d*. A GTO thyristor exhibits very low leakage currents even at high operating temperatures. Thus, a continuous mode exciter according to the invention will provide a constant spark rate over a wide range of temperatures. Also, GTO devices have high sustaining currents compared to conventional SCR devices. Therefore, GTO devices can be used with the continuous mode charging circuitry of the present invention without the need for the half wave rectifier. This is because the higher sustaining currents of the GTO allow the device to turn off as the capacitor 38 discharges, without the need for the half-wave commutation period needed by SCR devices.

The continuous mode technique is a significant improvement over the pulse width modulated exciter designs that rely on timer circuits to maintain a constant spark rate. Those skilled in the art will also appreciate that conventional SCRs exhibit high leakage currents at elevated operating temperatures. These leakage currents can affect the spark rate timing due to their load on the charging of the main capacitor 38. Leakage may cause, for example, charging power loss of 1 to 2 watts with conventional SCRs. However, in some applications the total power delivered by the charging circuit far exceeds the total power loss due to leaky SCRs even at elevated temperatures. In such circumstances, the continuous mode exciter as described herein can be used to achieve a spark rate that is sufficiently constant for engine specifications. The use of the half-wave doubler circuit permits the self-commutation to occur thus obviating the need to interrupt power to the discharge circuit.

The efficiency of the exciter 10 can be further improved by physically placing the current multiplier 76 at the plug 12. This substantially lowers the currents through the discharge circuit 22 and the high tension lead 14. The current multiplier concept can be applied to any exciter, including those of the spark gap switching device type, to realize this improvement in output efficiency. Also, the current multiplier is particularly advantageous with solid-state switches such as SCRs and GTOs because the exciter can achieve the same peak output power characteristics of a spark gap exciter while reducing the di/dt and peak currents in the switching devices to safe operating values. Use of the current multiplier also reduces the peak currents discharged from the main storage capacitor 38, which can be expected to improve the operating life of the main capacitor.

A significant problem that can occur with capacitive discharge circuits is the presence of stray inductance (primarily from the return line 16) in the inner current loop of the discharge circuit 22 consisting of the main capacitor 38, the switching devices 46*a–d* and the free wheeling diode 71, back to the return 16. These stray inductances can cause excessive reverse voltage surges to appear across the switching devices 46. When the switching devices 46 are conventional thyristors, such as an SCR, these reverse voltage can destroy the device. Therefore, in the past it has been common to place a clamping diode in reverse parallel with each SCR. The clamping diode is intended to turn on in response to reverse voltages appearing across the respective SCR and thus protect the device. We have discovered, however, that this approach can be ineffective in many cases because the turn on time of the clamping diodes may not be fast enough to respond to the reverse voltage surges from the stray inductance. Consequently, excess reverse voltage can still appear across the SCR and cause degradation or failure. This was particularly noted with GTO type thyristors which are very sensitive to reverse voltages. In accordance with another aspect of our invention, we have removed the reverse parallel diodes and instead provide a diode rectifier 150 in parallel with the main storage capacitor 38. It will be noted that the free wheeling diode 71, which is also in the outer current loop of the discharge circuit (consisting of the inductor 74, the current multiplier 76, the plug 12 and the diode 71), is ineffective against the stray inductances of the inner loop. Furthermore, because the clamping diode 150 is in series with the switching devices 46 which are in parallel with the free wheeling diode 71, the clamping diode 150 should be chosen to have a higher internal resistance so as not to divert arc current from diode 71 through the switches 46 when energy is transferred from the inductor 74 to the plug 12. The rectifier 150 prevents reverse voltages and charging currents from occurring due to the inner loop stray inductances, thus protecting the switching devices 46.

We have further found that when a series string of switching devices 46 is used, the devices may have different transition times for turning on when the gate terminals are triggered. This can result in excessive voltages across the anode/cathode junction of the slower devices. For example, in FIG. 1, if devices 46*a* and 46*b* begin to conduct current at an appreciably faster rate than device 46*c*, excessive anode/cathode voltages may appear across the slower device 46*c*. To reduce this effect, we have provided snubber circuits 200 for each switching device 46*a–46d*. Each snubber circuit 200 operates in substantially the same manner, therefore, only one will be described.

Each snubber circuit 200 includes a capacitor 202, a diode 204, and a gate return resistor 206. A series string of static balancing resistors 208 are also provided. The snubber capacitor 202 is connected between the diode 204 and the corresponding gate terminal 48*a–48d* of the switching device 46*a–46d*. For purposes of explaining operation of the snubber circuits 200, assume that switching device 46*a* and 46*b* begin to turn on before device 46*c*. Without the snubber circuits, voltage would rapidly build across the anode/cathode junction of the slower device. However, with the snubber circuit 200 in place, this excess charge is shunted away from the switching device and charges the snubber capacitor 202 through the snubber diode 204. Because the snubber capacitor is also connected to the gate terminal of the slower switching 46*c*, the charging of the capacitor adds a boost to the gate drive signal from pulse transformer 50*c* in order to drive the slower device harder. The effect of this is to help turn on the switching device 46*c* faster. The static balancing resistor 208 in each snubber circuit serves at least two purposes. First, these resistors operate in a conventional manner to provide static balance across the switching devices so that no single device 46*a–46d* sees an excessive anode/cathode potential while the main capacitor 38 is charging. The balancing resistors 208 also serve to discharge the snubber capacitors after each spark discharge period of the exciter 10.

We have found that the snubber circuit 200 is particularly useful when the switching device is a GTO type thyristor. This is because these devices are particularly susceptible to excess anode/cathode voltages due to slower and less predictable turn on time delays from the time that the gate current is applied to the time that the device operates in the thyristor region. When conventional SCRs are used for the switching devices, however, the devices exhibit fairly consistent and predictable turn on delays that are short enough that additional drive to the gate terminals is not needed. Therefore, a snubber circuit for conventional SCR devices can be used that has the snubber capacitor connected between the snubber diode and the cathode of the SCR. This snubber design simply shunts any charge build up due to devices 46 turning on at different rates around the slower devices.

It will also be noted that each snubber circuit 200 includes a diode 210 connected between the gate terminal 48*a*–48*d* and the corresponding pulse transformer 50*a*–50*a*. This diode is provided to block current from the snubber capacitor 202 from being shunted away from the gate terminal 48*a*–48*d* due to the low impedance of the pulse transformer secondary winding. This diode is not needed in an SCR snubber circuit because the latter returns the snubber capacitor current to the SCR cathode, not the gate terminal.

With reference now to FIG. 3A, an alternative embodiment is shown for a high tension discharge circuit. In some engine designs, the plug 12 requires a high voltage level to generate the spark across the plug electrodes. This voltage may be on the order of 15 kV or higher. Because solid-state switches cannot withstand such high voltages, a voltage step-up transformer is used in the output circuit 72. The use of voltage step-up transformers for high tension exciters has been well known since the 1960s. A typical design includes a transformer T3 having a primary winding connected in series with the main capacitor 38 (not shown in FIG. 3A) and an excitation capacitor 90. The transformer T3 secondary 92 is connected in series with the plug 12. When the switching devices 46*a*–*d* are triggered on, discharge current from the capacitor 38 initially flows through the primary of T3 until the capacitor 90 charges. During this time a high voltage spike is induced in the secondary 92 that appears across the plug 12 to create a spark. After the capacitor 90 charges, the primary of T3 no longer conducts current, and the capacitor 38 completes discharge through the secondary 92 and the current multiplier. As shown in FIG. 3A, the step-up transformer T3 can be used in parallel with the current multiplier 76 of the present invention to first provide high voltage at low current to the plug 12 in order to initiate the spark and then provide low voltage and high current to the plug 12. FIG. 3B shows yet another variation in which the current multiplier 76 and voltage step-up transformer can be realized using a single transformer T4. In this embodiment, discharge current from the capacitor 38 initially flows through the primary 94 and excitation capacitor 96. This creates a high voltage spike in the center tapped secondary winding 98 and a high current spike in the other secondary winding 100. After the capacitor 96 charges, the main capacitor 38 completes its discharge through the secondaries 98,100.

It will also be appreciated that the exemplary configuration shown in FIG. 1 can be easily modified with respect to polarities of the charging current, capacitor 38 and the switching devices 46. In other words, for example, the switching devices could be reversed and the capacitor 38 negatively charged by the charging circuit 20. The switching circuit, generally outlined by the box 300, could also be interchanged positionally with the main capacitor 38. Thus, the particular topology of the circuit shown and described with respect to FIG. 1 is not critical to realize the advantages of the invention, and can be easily changed to suit the needs of the specific application.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

We claim:

1. An exciter for an internal combustion engine igniter plug, said exciter comprising a charging circuit and a discharge circuit; said discharge circuit being connectable to the plug to cause the plug to produce sparks; said charging circuit being connectable to an AC power source that continuously delivers power to said charging circuit; said discharge circuit comprising a storage capacitor that is charged by current from said charging circuit; a solid state switching device connected between said capacitor and the plug; and a trigger circuit for triggering said switching device based on said capacitor charge.

2. The exciter according to claim 1 wherein said discharge circuit further comprises a half-wave rectifier connected between said charging circuit and said capacitor such that alternating half-cycles of charging current are blocked thereby providing a commutation period for said switching device after discharge.

3. The exciter according to claim 2 wherein said switching device is a thyristor.

4. The exciter according to claim 3 wherein said thyristor is an SCR device.

5. The exciter according to claim 1 wherein said charging circuit includes a transformer having a primary winding and a secondary winding and current regulating inductance in series with said transformer primary winding.

6. The exciter according to claim 1 wherein said discharge circuit further comprises a current multiplier connected between said switching device and the plug to substantially increase current through the plug when said capacitor discharges.

7. The exciter according to claim 6 wherein said switching device is a GTO.

8. The exciter according to claim 1 wherein said discharge circuit further comprises a voltage step-up circuit connected between said switching device and the plug.

9. The exciter according to claim 8 wherein said trigger circuit comprises a comparator for comparing said capacitor charge with a reference voltage, said comparator producing a trigger signal in response to a predetermined relationship between said capacitor voltage and said reference voltage.

10. The exciter according to claim 4 wherein said charging circuit produces at least 10 watts charging power.

11. The exciter according to claim 1 wherein said charging circuit charges said storage capacitor at a generally constant rate between sparks.

12. In an exciter of the type used for supplying high energy power to an igniter plug and further having a charging circuit, a capacitor charged by said charging circuit, and a discharge circuit having a switching device for controlling the discharge of energy stored in said capacitor to the plug, the improvement comprising a current multiplier connected between said switching device and the plug.

13. The improved exciter according to claim 12 wherein said current multiplier is structurally positioned near the plug to reduce power loss during discharge of said capacitor.

14. The improved exciter according to claim 12 wherein said current multiplier comprises an transformer having a first winding in series between said switching device and the plug, and a second winding connected to the plug so that current applied to the plug during discharge is substantially greater than current discharged from said capacitor.

15. The improved exciter according to claim 12 wherein said current multiplier is connected to a voltage step-up circuit.

16. The improved exciter according to claim 15 wherein said current multiplier and voltage step-up circuit comprise a single core transformer having a first winding connected in series with said switching device and capacitor, a second winding connected to substantially increase the voltage across the plug before an arc is struck, and a third winding connected to the plug to substantially increase current to the plug after an arc is struck.

17. The improved exciter according to claim 14 further comprising a diode in series between said secondary winding and the plug.

18. A method for producing a generally constant spark rate of an igniter plug in an engine, comprising the steps of:

a. producing a rectified charging current from a continuous AC power source;

b. charging a capacitor with said charging current at a generally constant rate of charge between sparks;

c. detecting the charge on said capacitor;

d. triggering a switching device in response to charge on said capacitor to discharge said capacitor through the igniter plug; and e. turning the switching device off during a non-charging period of said charging current after said capacitor discharges.

19. The method of claim 18 further comprising the step of substantially increasing current delivered to the igniter plug during discharge of the capacitor using a current multiplier.

20. The method of claim 19 wherein the step of producing a half-wave rectified charging current is performed using a half-wave voltage doubler circuit connected to said capacitor and the AC power source.

21. The method of claim 19 wherein the step of substantially increasing the current delivered to the igniter plug follows a step of substantially increasing the voltage applied to the plug during discharge of said capacitor.

22. In an exciter of the type used for supplying high energy power to an igniter plug and further having a charging circuit, a capacitor charged by said charging circuit, and a discharge circuit having two or more series connected solid state switching devices for controlling the discharge of energy stored in said capacitor to the plug, the improvement comprising a snubber circuit connected to each of said switching devices, said snubber circuit comprising a gate drive capacitor connected between a gate and anode of said switching device.

* * * * *